US007214139B2

(12) United States Patent
Parris et al.

(10) Patent No.: US 7,214,139 B2
(45) Date of Patent: May 8, 2007

(54) GOLF SWING AID

(76) Inventors: H. Lindsey Parris, 616 King's Cloister Cir., Alexandria, VA (US) 22302; Chris Ries, 5905 Coverdave Way, Alexandria, VA (US) 22310; Andrew Viglucci, 220 Medlock La., Alexandria, VA (US) 22304

( * ) Notice: Subject to any disclaimer, the term of this patent is extended or adjusted under 35 U.S.C. 154(b) by 0 days.

(21) Appl. No.: 10/971,325

(22) Filed: Nov. 9, 2004

(65) Prior Publication Data

US 2006/0100026 A1 May 11, 2006

(51) Int. Cl.
*A63B 69/36* (2006.01)

(52) U.S. Cl. ..... 473/212; 473/207; 473/208; 473/274; 473/276

(58) Field of Classification Search ..... 473/207, 473/208, 211–216, 266–277
See application file for complete search history.

(56) References Cited

U.S. PATENT DOCUMENTS

| | | | | |
|---|---|---|---|---|
| 2,774,601 | A * | 12/1956 | White | 473/208 |
| 3,346,257 | A * | 10/1967 | Whitney | 473/215 |
| 3,643,960 | A | 2/1972 | Gentilly | |
| 3,713,657 | A | 1/1973 | Presta | |
| 3,850,164 | A * | 11/1974 | Hare | 602/18 |
| 4,300,765 | A | 11/1981 | Stringham | |
| 4,527,982 | A | 7/1985 | Salzman et al. | |
| 4,637,612 | A | 1/1987 | Wilkins | |
| 5,375,842 | A | 12/1994 | Plottner | |
| 5,746,663 | A | 5/1998 | Calace | |
| 6,219,865 | B1 * | 4/2001 | Stokesbary | 5/637 |
| 2002/0039930 | A1 | 4/2002 | Smith | |
| 2003/0083139 | A1 | 5/2003 | Bickett | |

* cited by examiner

*Primary Examiner*—Nini F. Legesse
(74) *Attorney, Agent, or Firm*—Cislo & Thomas, LLP

(57) ABSTRACT

Exemplary embodiments provided herein may include a method and system for indicating to a user when the user has performed an improper golf swing, including a positioning portion, and an indicating portion coupled to the positioning portion, where the indicating portion is selectively positional via the positioning portion, adjacent a user to provide an indication when the user performs an improper swing.

18 Claims, 4 Drawing Sheets

GOLF SWING AID

BACKGROUND

The traditional concepts of a good golf swing may involve a series of interrelated and independent actions on the part of the golfer. While no two golfers who possess a great amount of skill have identical golf swings, there may be certain actions involved in a good golf swing that a golfer must either do or not do. For example, golf instructors may often teach a right-handed golfer to keep his left arm straight during the back swing and through impact of the golf club with the golf ball being struck.

The well-executed golf swing involves hand-eye coordination as well as shoulder and head positioning. What is needed is a system, method and/or device for teaching a golfer proper head and shoulder positioning during a golf swing so that a golfer may be taught, and repeat, the elements of a fundamentally sound golf swing.

SUMMARY

Exemplary embodiments provided herein may include a method and system for indicating to a user when the user has performed an improper golf swing, including a positioning portion, and an indicating portion coupled to the positioning portion, where the indicating portion is selectively positional via the positioning portion, adjacent to a user to provide an indication when the user performs an improper swing.

DETAILED DESCRIPTION

The detailed description set forth below in connection with the appended drawings is intended as a description of exemplary embodiments and is not intended to represent the only forms in which the embodiments may be constructed and/or utilized. The description sets forth the functions and the sequence of steps for constructing and operating illustrated embodiments. However, it is to be understood that the same or equivalent functions and sequences may be accomplished by different embodiments that are also intended to be encompassed within the spirit and scope of this disclosure.

Figure 1:
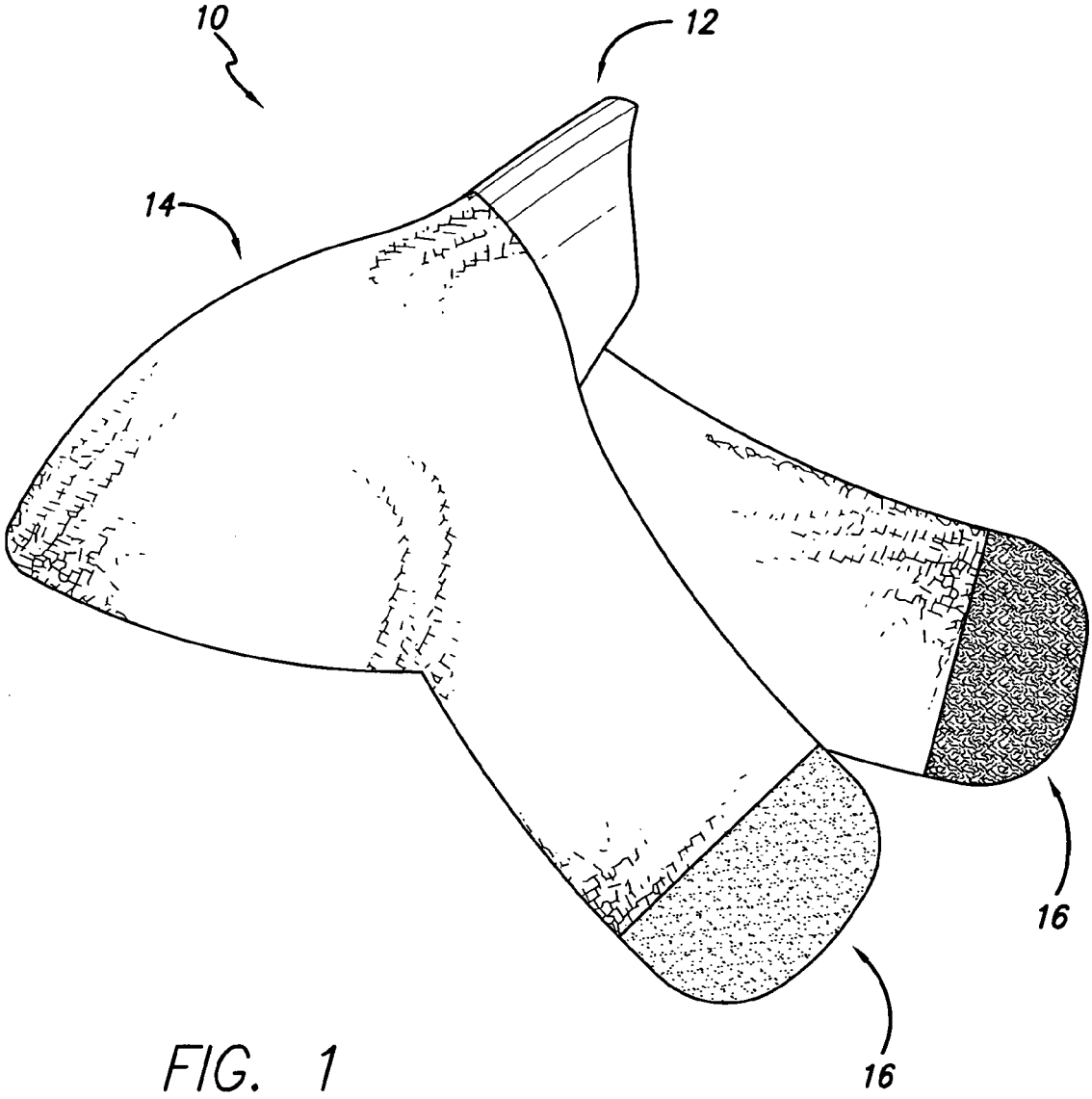
FIG. 1 is a perspective view of a golf swing aid according to one exemplary embodiment.

FIG. 1 shows a system for teaching proper head and shoulder positioning during a golf swing according to an exemplary embodiment, generally at 10. System 10 may include an indicating portion 12 and a positioning portion 14. Indicating portion 12 may be coupled to positioning portion 14 in many different ways, including adhesives, a sewn seam, or as one integral piece, or other methods and configurations, as desired.

Positioning portion 14 may include securing portion 16 which may be configured to couple together to affix the system to a user, as desired. Furthermore, securing portion 16 may couple directly to the shirt or clothing of a user, as desired. It will be appreciated that although a hook and loop-type securing portion is shown, many other coupling methods and configurations may be utilized without straying from the concepts of this disclosure.

Indicating portion 12 may be made of a plastic, metal, polymers, or other rigid or semi-rigid materials, or combinations thereof, as desired. It will be appreciated that indicating portion 12 may also be made of a soft foam, fabric, or other comfortable material to provide feedback to a golfer when it contacts the golfer's head and/or head area. Positioning portion 14 may be made of elastic or stretchable fabric, spandex-type, other stretchable fabric, or other comfortable fabric, as desired. Securing portion 16 may be a hook and loop type configuration, adhesive, friction coupling, or other type of method or system to couple the ends together.

Figure 2:
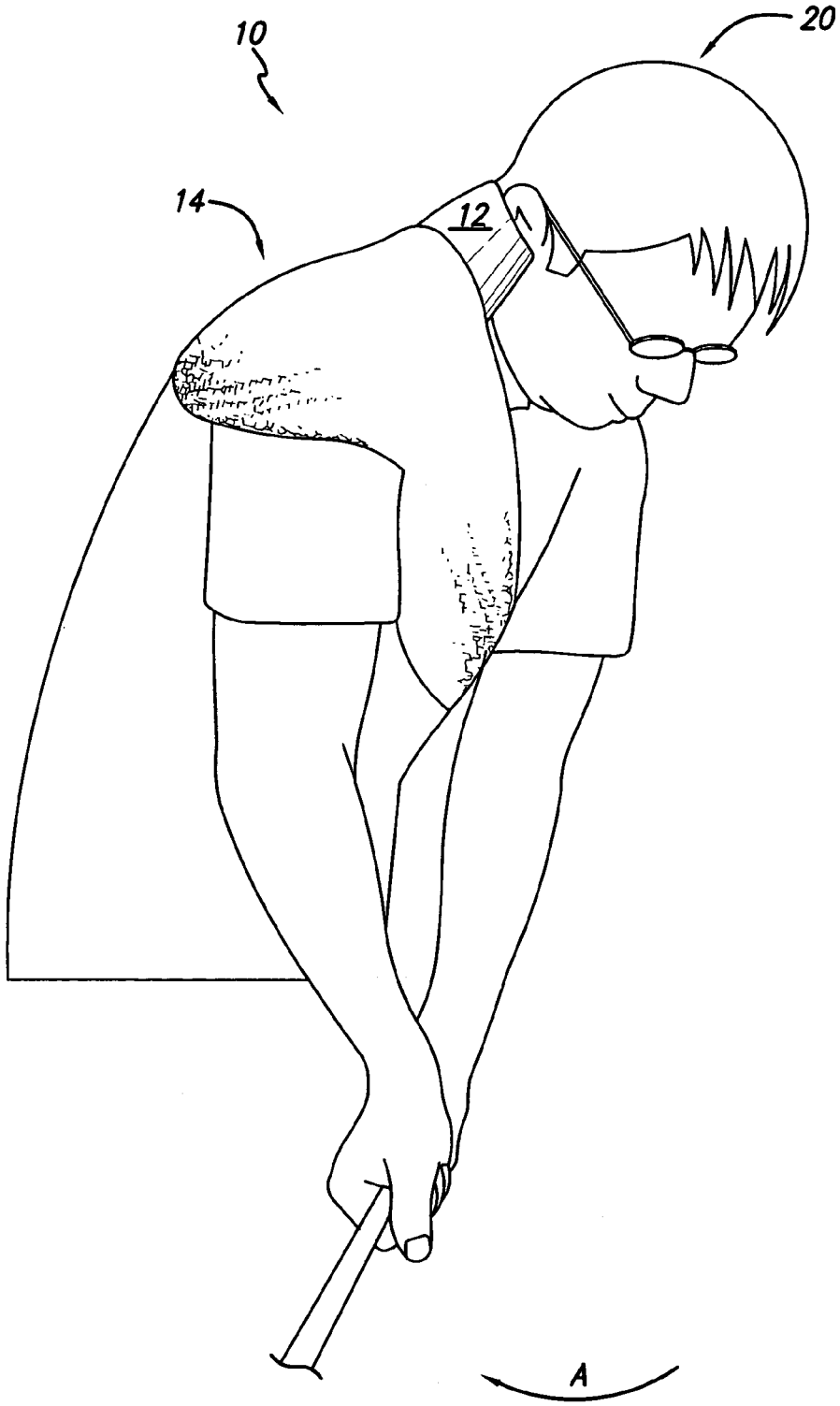
FIG. 2 is a perspective view of a golf swing aid being utilized by a golfer, showing an improper backswing.

FIG. 2 shows the system utilized by avid golfer 20 when avid golfer has an improper backswing as shown by directional arrow "A." In this particular figure, the golfer has taken the club away abruptly outside of the target line, causing the golfer's back shoulder to move higher than the other shoulder. As a result, the indicating portion 12 may move and provide tactile indication of the improper head and/or shoulder position during the swing. In this instance indicating portion 12 contacts the golfer's head, thereby providing the golfer 20 with sensory and/or tactile feedback that the takeaway/back swing is improper.

Figure 3:
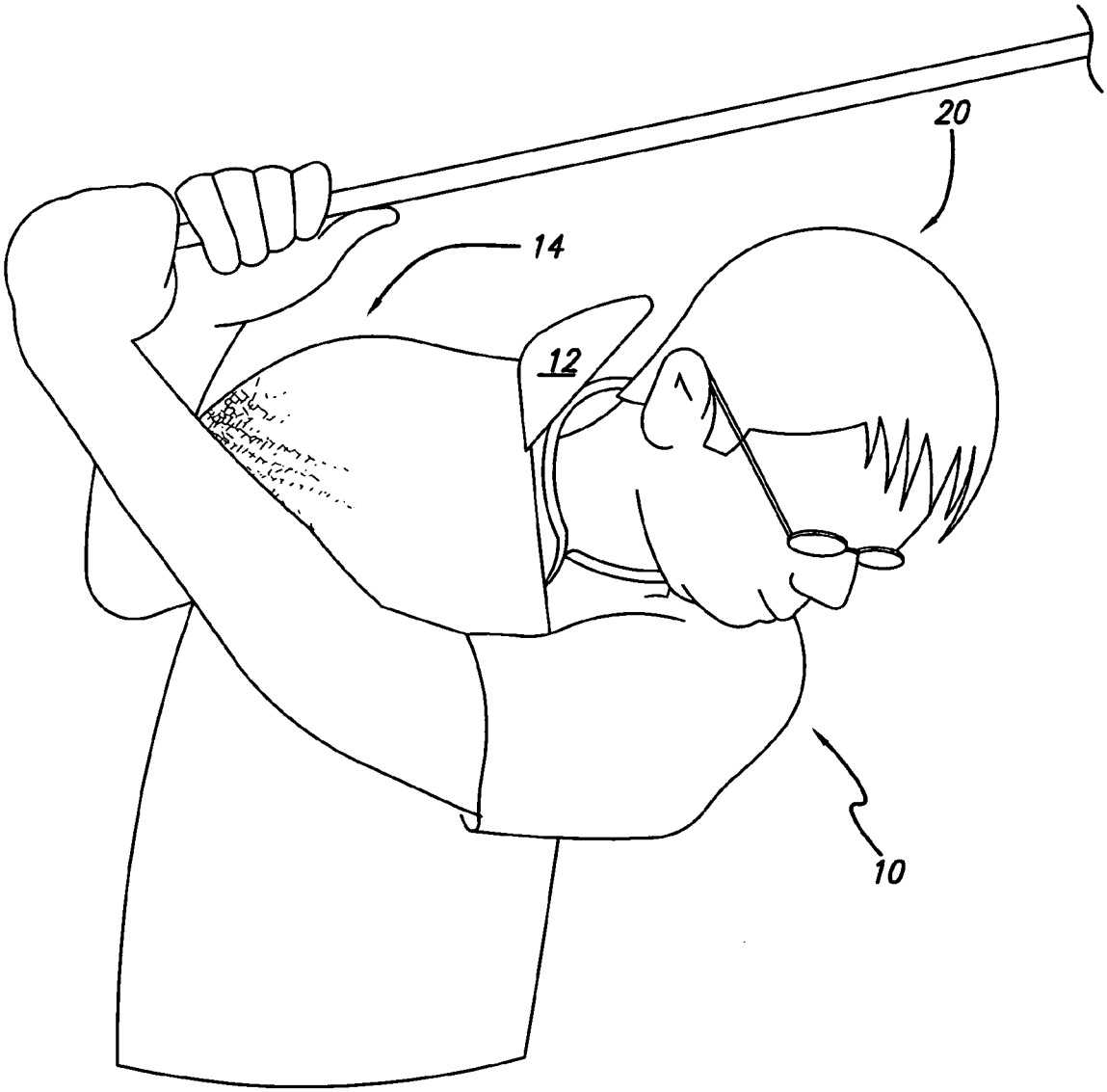
FIG. 3 is a perspective view of a golf swing aid being utilized by a golfer, showing proper positioning at the top of a golf swing.

FIG. 3 shows the use of a system 10 being utilized by avid golfer 20. In this figure avid golfer 20 is at the top of the swing. Furthermore, avid golfer has used a fundamentally sound swing and therefore indicating portion 12 is not touching the golfer's head area. As shown indicating portion 12 will not contact avid golfer 20's general head area until after the swing is complete. As discussed above and below, indicating portion 12 will contact the head and/or neck area of avid golfer 20 if an improper swing is initiated or accomplished. Again system 10 may include a positioning portion 14 which may be selectably adjustable to move the position of indicating portion 12 with respect to the head of avid golfer 20, as desired.

Figure 4:
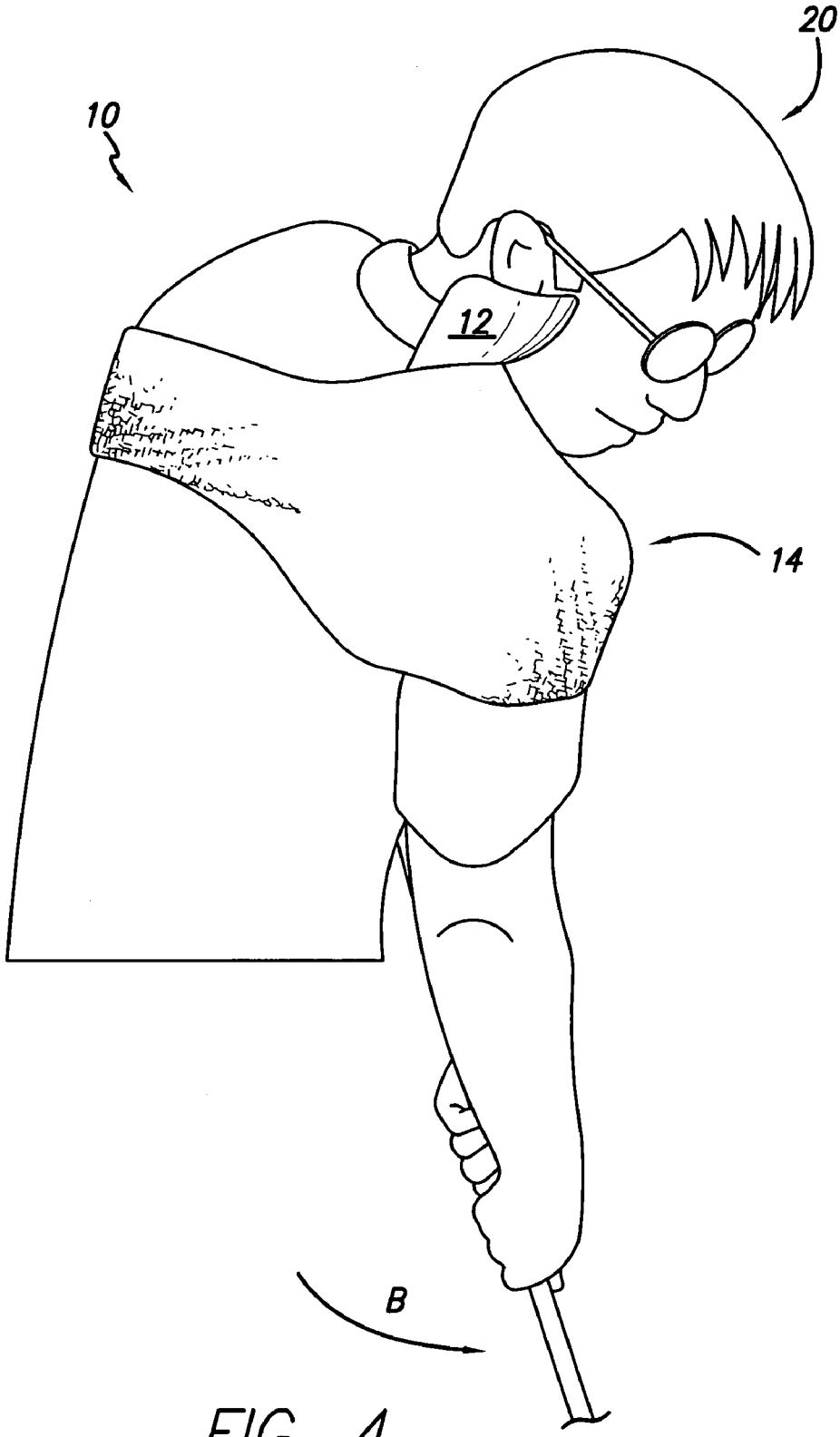
FIG. 4 is a perspective view of a golf swing aid being utilized by a golfer, showing an improper downswing.

FIG. 4 shows system 10 being used by an avid golfer 20. As shown in this figure, positioning portion 14 may be configured to be adjacent to a golfer's back shoulder (he back shoulder being the right shoulder of a right-handed golfer or the left shoulder of a left-handed golfer). Positioning portion 14 may be positioned such that indicating portion 12 may be near a golfer's head. With this configuration and position, if a golfer uses the correct head and shoulder positioning during a swing, the golfer's head may not come in contact with indicating portion 12.

As shown, positioning portion 14 may be adjacent to a golfer's shoulder and securing portion 16 may secure under the golfer's opposite arm, such that it may be comfortable and selectively positional for each individual golfer, such that indicating portion 12 may be positioned at many different locations adjacent a golfer's head. In FIG. 2 the golfer has executed an improper downswing along directional arrow "B" in that the right shoulder of the player is moving outside of the target line, forcing the golf club to move across the ball on an outside to inside swing path. As a result, indicating portion 12 contacts the golfer's head and provides the golfer with sensory and/or tactile indication that the downswing has been improper. It will be appreciated that although positioning portion 14 is shown generally covering a golfer's back shoulder, that other configurations and positions may be utilized to position indicating portion 12 near a golfer's head to provide sensory feedback when the player's swing is improper. This selectively positional configuration may also be utilized for different size and type of golfer such that it may be utilized for virtually any golfer with any golf swing, however unorthodox.

The device disclosed herein may be new and revolutionary in both concept and design. The device's unique shape, size and strategic location on the shoulder/neck may provide the player sensory feedback during correct and/or incorrect elements of a fundamentally sound golf swing. Muscle memory, once developed, may be difficult to change in the absence of regular, consistent reminders. This may be provided by exemplary embodiments, which may be designed to provide proper feedback to the golfer, with or without the presence of a qualified teaching professional.

Exemplary embodiments may provide mobility for the user, and may conform to the golfer's individual physical characteristics and stature, and non-intrusive and non-cumbersome to use. These features of the configuration may make the device more appealing to users. Exemplary embodiments may also offer the golfer opportunities to develop or improve his/her bio-mechanical swing pattern during practice sessions on the driving range and to reinforce them during "on course" play.

Exemplary embodiments disclosed herein may promote the proper shoulder rotation necessary to a fundamentally proper golf swing consistent with current PGA (Professional Golfers' Association) teaching methods, and consistent scoring success. Through the presence or absence of feedback and/or indication, exemplary embodiments may encourage the proper bio-mechanical swing in general, and shoulder rotation in particular, by indicating to the golfer when they lapse into the two most common culprits of poor swings: the excessively steep backswing, in which the golf club is drawn back with an uneven, rocker-panel shoulder motion rather than a rotation of the shoulders about the neck, and the "over-the-top" downswing, in which the club head becomes an axe blade swinging down and over (rather than around and through) the ball and outside the target line.

In addition, exemplary embodiments may enable golfers to train themselves in the "non-restricted" swing pattern employed by many male and female golfing professionals, and others. By providing feedback to the player, exemplary embodiments may train a golfer's head to stay in line with the center of the chest during the golf swing. This may help eliminate another common swing error-swinging "from the top" (another name for the "over-the-top" problem mentioned above), and may promote/enhance the golfer's shifting his/her weight in the proper sequence and at the proper time to enable the body to focus more energy into the swing, thus releasing and directing it towards the target.

The "getting to the left," an action, which must occur at the right time for a more proper swing, is common to all swings, traditional and non-restricted. When this "shift" occurs prematurely or late, the best result is that distance will be compromised, with other results ranging from slices and duck hooks to sky balls and "hosels." While the classic PGA swing pattern stresses eye contact on the ball through point and/or time of impact, in the "non-restricted" swing, the player does not look at the ball at impact (the amount of time the golfer would not be looking directly at the ball from beginning of downswing until impact is less than two-tenths of a second), but rather synchronizes the head turn with the body turn, rotating both in the direction of the target simultaneously. This may also promote another of golf's instructional mandates—"let the ball get in the way of the swing"—and may eliminate some of the elements of timing involved in squaring the clubface to the line of swing at the point of impact, because this "squaring-up" may occur naturally as a direct consequence of the non-restricted swing.

Whether for the classic or non-restricted swing, exemplary embodiments disclosed herein may allow a player to target one specific area of the golf swing with the proper placement adjacent the shoulder. Golfers may then hold themselves accountable to a single swing malady at a time, allowing them to address and eliminate these flaws individually, rather than working on everything simultaneously. Relocating the device at different positions in relation to the shoulder may permit feedback in multiple areas, putting the entire swing into context for the user The main components of a golf swing may be universally taught and appropriate to players of all ability levels. Because the primary flaws in proper technique may be common across all ability levels, exemplary embodiments are of potential use to every golf teaching professional in the country as well as to every golfer interested in unmistakable and accurate feedback as a way to improving their swing by developing muscle memory consistent with fundamentally sound swing mechanics. In addition, with the growing popularity of the non-restricted swing, the increasing recognition that it may lead to effective habits, and its special usefulness to those with physical challenges, this device may be unique in its adoptability to incorporate the central feature of the non-restricted swing while adhering to the other key elements of a biomechanically correct swing, and in reinforcing it during golf range practice sessions as well as on the course during a round. Those with infirmities that restrict mobility can especially benefit from the method and the apparatus. Those with bad hips, prostheses, painful lower backs (perhaps due to the strain induced by the "reverse C" finish position characteristic of many classic swings), or otherwise limited mobility (perhaps due to excess weight), can better groove their swings and "get to the left" more efficiently and painlessly. That is, a correct finish position—more level and more vertical than the still-correct-but-difficult "reverse C"—is achievable more consistently by a greater proportion of players.

While the exemplary embodiments have been described with regard to exemplary embodiments, it is recognized that additional variations may be devised and/or utilized without departing from the concepts disclosed herein. In closing, it is to be understood that the embodiments described herein are illustrative of the principles of exemplary embodiments. Other modifications that may be employed are within the scope of this disclosure. Thus, by way of example, but not of limitation, alternative configurations may be utilized in accordance with the teachings herein. Accordingly, the drawings and description are illustrative and not meant to be a limitation thereof.

What is claimed is:

1. A system for teaching a proper golf swing, comprising:

a positioning portion that substantially conforms to only one of either of the user's shoulders and is selectively positional thereto; and an indicating portion coupled to said positioning portion at the user's shoulder area to provide sensation to a user's head, neck, ear, jaw, or cheek area, wherein said indicating portion is selectively positional via said positioning portion adjacent to but not touching the side of the user's head, neck, ear, jaw, or cheek area so that the indicating portion provides a tactile sensation to those areas only when the user performs an improper swing.

2. The system of claim 1, wherein said positioning portion includes a securing portion configured to couple said positioning portion to a user.

3. The system of claim 1, wherein said indicator provides a tactile indication to the user.

4. The system of claim 3, wherein said indicator contacts the head area of a user to provide said indication.

5. The system of claim 1, wherein said indicating portion is coupled to the back shoulder of a user.

6. The system of claim 1, wherein said securing portion is hook and loop-type material.

7. A system for teaching a proper golf swing, comprising:

a positioning portion including a securing portion, configured to couple to only one of either of the back shoulders of a user; and an indicating portion coupled to said positioning portion, wherein said indicating portion is selectively positional on the back shoulder of a user to contact the head, neck, ear, jaw, or cheek area of a user only when the user performs an improper swing.

8. A method of teaching proper positioning of the head and shoulders of a user during a golf swing, comprising:

providing a tactile indicator; and positioning said tactile indicator adjacent to but not contacting a user's neck, cheek, jaw, or ear area prior to the swing;

coupling said system to a user;

contacting user's head, neck, ear, jaw, or cheek area with said tactile indicator only during an improper swing to indicate to a user when the user performs an improper swing.

9. A system for teaching a proper golf swing, comprising:

a positioning portion including a securing means, configured to be adjacent to only one of either of the back shoulders of a user; and an indicating portion coupled to said positioning portion, wherein said indicating portion is selectively positional adjacent only one of either of the back shoulders of a user to provide tactile indication to a user by contacting the head, neck, ear, jaw, or cheek area of a user in closest proximity to said positioning portion, only when the user performs an improper swing.

10. A system for teaching a proper golf swing, comprising:

a positioning portion that substantially conforms to only one of either of the user's shoulders; and an indicating portion coupled to said positioning portion, wherein said indicating portion is selectively positional via said positioning portion, adjacent the back shoulder of a user to provide an indication only when the user performs an improper swing.

11. The system of claim 10, wherein said positioning portion includes a securing portion configured to couple said positioning portion to a user.

12. The system of claim 10, wherein said indicator provides a tactile indication to the user.

13. The system of claim 12, wherein said indicator contacts the head area of a user to provide said indication.

14. The system of claim 10, wherein said securing portion is hook and loop-type material.

15. A system for teaching a proper golf swing, comprising:

a positioning portion configured to couple to the back shoulder of a user; and an indicating portion coupled to said positioning portion, wherein said indicating portion is selectively positional on the back shoulder of a user to contact the head area of a user only when the user performs an improper swing.

16. A method of teaching proper positioning of the head and shoulders of a user during a golf swing, comprising:

providing a tactile indicator; and positioning said tactile indicator adjacent only either of one of the back shoulders of a user;

coupling said system to the user;

utilizing said tactile indicator to indicate to a user only when the user performs an improper swing, by the tactile indicator contacting the head, neck, ear, jaw, or cheek area of the user during the improper swing.

17. A system for teaching a proper golf swing, comprising:

a positioning portion configured to couple to the shoulder of a user, comprising a flexible material that substantially conforms to only one of either of the user's shoulders;

a coupling portion that couples the positioning portion to the shoulder of the user, and an indicating portion coupled to said positioning portion, comprising an element at least a portion of which is substantially vertical, to provide tactile sensation when the indicating portion comes in contact with the user, wherein said indicating portion is selectively positional on the shoulder of a user to contact the head, ear, cheek, jaw, or neck area of a user only when the user performs an improper swing.

18. A method for of teaching proper positioning of the head and shoulders of a user during a golf swing, comprising:

providing a tactile indicator;

coupling the tactile indicator to a positioning element configured to couple to the shoulder of a user, comprising a flexible material that substantially conforms to only one of either of the user's shoulders;

positioning said tactile indicator adjacent to but not contacting a user's cheek, ear, and neck area in closest proximity said positioning element;

contacting the user's head, neck, cheek, jaw, or ear area with said tactile indicator only during an improper swing.

* * * * *